US005800693A

United States Patent [19]

Kakizaki et al.

[11] Patent Number: 5,800,693

[45] Date of Patent: Sep. 1, 1998

[54] METHOD FOR SURFACE-TREATING SUBSTRATE AND SUBSTRATE SURFACE-TREATED BY THE METHOD

[75] Inventors: Masahiko Kakizaki, Tokyo; Masahiro Akimoto, Kanagawa, both of Japan

[73] Assignees: Sony Corporation, Tokyo; Denka Himaku Inc., Kanagawa, both of Japan

[21] Appl. No.: 771,154

[22] Filed: Dec. 20, 1996

[30] Foreign Application Priority Data

Dec. 21, 1995 [JP] Japan ..... 7-333280

[51] Int. Cl.[6] ..... C25D 11/30

[52] U.S. Cl. ..... 205/50; 205/321; 428/469

[58] Field of Search ..... 205/321, 50; 428/469

[56] References Cited

U.S. PATENT DOCUMENTS

| | | | |
|---|---|---|---|
| Re. 29,739 | 8/1978 | Kessler | 205/321 X |
| 2,497,036 | 2/1950 | Simpson et al. | 204/56 |
| 3,620,939 | 11/1971 | Fruchtnicht | 205/321 X |
| 4,744,872 | 5/1988 | Kobayashi et al. | 204/58.4 |
| 4,976,830 | 12/1990 | Schmeling et al. | 205/321 X |

OTHER PUBLICATIONS

Patent Abstracts of Japan, vol. 12, No. 344 (C-528), 16 Sep. 1988 and JP 63100195 A, (Ube Ind Ltd), 2 May 1988.

*Primary Examiner*—Kathryn L. Gorgos
*Assistant Examiner*—William T. Leader
*Attorney, Agent, or Firm*—Hill & Simpson

[57] ABSTRACT

A method for surface-treating a substrate made of a magnesium-based metal material is disclosed, which includes immersing the substrate in an electrolyte composed of an aqueous solution containing at least one component selected from the group consisting of hydroxides, carbonates and bicarbonates of alkali metals or alkali earth metals, and a film-forming stabilizer, and conducting an electrolysis to form an anodic oxide film on a surface of the substrate. The film-forming stabilizer includes one component selected from salts of mineral acids, fluorides, silicates and silicofluorides and an additional component selected from ethylene glycol, trihydroxypropane, dihydroxyethyl ether and sodium hydroxybenzoate. Further, in accordance with the present invention, there is provided the substrate which is surface-treated by the method.

5 Claims, 2 Drawing Sheets

METHOD FOR SURFACE-TREATING SUBSTRATE AND SUBSTRATE SURFACE-TREATED BY THE METHOD

BACKGROUND OF THE INVENTION

1. Field of the Invention

The present invention relates to a method for surface-treating a substrate and the substrate surface-treated by the method, and more particularly to a novel method for surface-treating a substrate composed of magnesium or a magnesium alloy, which method enables formation of an anodic oxide film having a high quality on a surface of the substrate, whereby the surface-treated substrate can show a metallic color and can be improved in a surface smoothness, a corrosion resistance, an abrasion resistance and film-adhesion properties.

2. Prior Art

As is well known in the art, magnesium alloy materials have been widely utilized as a substrate for casings or structural elements in various fields such as computers, audio equipments, communication equipments, air planes, automobiles or the like, because these materials have the lightest weight among the practically used metals, and exhibit a good machinability, a high strength/density ratio and a high castabilty by a die-cast.

However, the magnesium alloy materials have a tendency that they are readily oxidized in an atmosphere so that a thin oxide film is formed on a surface thereof. In consequence, there arises such a problem that, when it is intended to form a box-shaped casing or container from such a magnesium alloy material and provide a coating layer thereon, not only the coating is associated with difficulty but also adhesion of the coating layer to the box-shaped casing or container is considerably deteriorated. Further, these magnesium alloy materials show considerably deteriorated corrosion resistance when exposed to sea water, aqueous chloride solutions or acids.

For this reason, conventionally, in order to enhance the corrosion resistance, the abrasion resistance or the film adhesion properties of the magnesium alloy materials, salts of heavy metals such as chromates (hexavalent chromium), manganates, permanganates are used to form an anodic oxide film thereon.

However, in the case where the anodic oxidation is conducted using such salts of heavy metals, undesired effluent containing toxic substances comes from the anodic oxidation system, resulting in severe environmental pollution.

Further, the wear-resistant anodic oxide film produced in the afore-mentioned manner has a surface roughness three to ten times that of the raw material, so that it is extremely difficult to obtain a product with an accurate dimension by mechanical processing. For this reason, the product has been generally subjected to a polishing process. However, since the anodic oxide film is hard but brittle, the film is likely to fall off in such a polishing process.

Furthermore, the anodic oxide film is provided therein with numerous pores of complicated shapes having a diameter of 3 to 10 μm, so that abraded powder formed during the polishing process is invaded or adhered into the numerous pores or irregularities on the surface thereof. In addition, when such the powder falls off, the anodic oxide film is apt to suffer from self-deconstruction in the polishing process, because the falling-off powder plays a role as an abrading agent.

Besides, since the anodic oxide film has a large surface roughness as described above, there has been an inconvenience that it is extremely difficult to control a thickness of the anodic oxide film.

SUMMARY OF THE INVENTION

The present invention has been made to overcome the afore-mentioned problems.

Accordingly, it is an object of the present invention to provide a method for surface-treating a substrate, which method enables the production of an anodic oxide film having good corrosion resistance, abrasion resistance, surface roughness and hardness.

It is another object of the present invention to provide a method for surface-treating a substrate, which method does not include a step using toxic heavy metals nor give a resultant product containing any toxic substances, whereby re-melting of the surface-treated substrate upon recycling can be performed without pre-treatments for eliminating the toxic substances by burning, peeling-off, separation, mechanical machining, chemical processing or the like.

In order to accomplish the afore-mentioned objects, the present inventors have made various experiments which have been carried out under the conditions in which incorporation of toxic substances is prevented as carefully as possible. As a result, it has been found that magnesium and a magnesium alloy is stable in a specific alkali range and, when an electrolysis (anodic oxidation) of the magnesium and the magnesium alloy is conducted in such a alkali range while controlling amounts of magnesium hydroxide or magnesium oxide produced in a well-balanced manner, an anodic oxide film having a high quality can be produced on a surface of the magnesium or the magnesium alloy.

The present invention has been found on the basis of the above-mentioned finding.

In an aspect of the present invention, there is provided a method for surface-treating a substrate made of magnesium or a magnesium alloy, which comprises the steps of immersing the substrate in an electrolyte composed of an aqueous solution containing at least one component selected from the group consisting of hydroxides, carbonates and bicarbonates of alkali metals or alkali earth metals, and a film-forming stabilizer, and conducting an electrolysis to form an anodic oxide film on a surface of the substrate.

In a second aspect of the present invention, there is provided a substrate made of magnesium or a magnesium alloy which is surface-treated by the above-mentioned method.

These and other objects, features and advantages of the present invention will become more apparent from the following description when read in conjunction with the accompanying drawings and the appended claims.

DETAILED DESCRIPTION OF THE INVENTION

Figure 1:
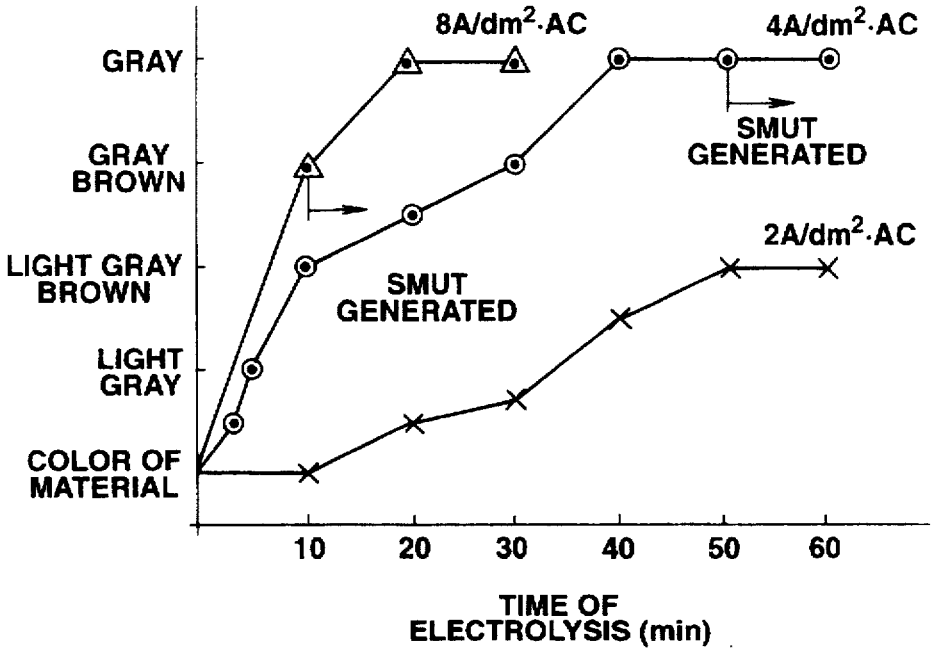
FIG. 1 is a characteristic curve showing a change in color tone of an anodic oxide film with respect to current densities and elapsed time of electrolysis.

The substrate to be surface-treated according to the present invention may be made of magnesium or magnesium alloy metal materials (hereinafter referred to merely as "magnesium-based metal material). Examples of the alloys of magnesium may include Mg-Al-based alloys, Mg-Mn-based alloys, Mg-Ca-based alloys, Mg-Ag-based alloys, Mg-rare earth element-based alloys, or the like.

In accordance with the present invention, the magnesium-based metal material is immersed in an electrolyte solution which is then subjected to an electrolysis, so that an anodic oxide film can be produced on the magnesium-based metal material. As the electrolyte solution, solutions composed mainly of an aqueous alkali solution to which a film-forming stabilizer (surface-hardening additive) is further added, can be suitably used.

Examples of the suitable aqueous alkali solutions may include those solutions containing hydroxides such as sodium hydroxide (NaOH), potassium hydroxide (KOH) or barium hydroxide ($Ba(OH)_2$), carbonates such as sodium carbonate ($Na_2CO_3$), potassium carbonate ($K_2CO_3$), calcium carbonate ($CaCO_3$), magnesium carbonate ($MgCO_3$) or ammonium carbonate ($(NH_4)_2CO_3$), bicarbonates such as sodium bicarbonate ($NaHCO_3$), potassium bicarbonate ($KHCO_3$), calcium bicarbonate ($Ca(HCO_3)_2$) or ammonium bicarbonate ($NH_4HCO_3$), or the like. These aqueous alkali solutions can be used singly or in the form of a mixture of any two or more thereof. The concentration of the aqueous alkali solution in the electrolyte solution is in the range of from about 0.2 to about 10 mol per liter preferably 0.5 to 7 mol per liter, more preferably 1 to 5 mol per liter. When the concentration of the aqueous alkali solution is less than 0.2 mol per liter, the electrolysis using such an aqueous alkali solution is likely to produce uneven anodic oxide film. In the meantime, if the carbonate having a low solubility is used in the preparation of the aqueous alkali solution, it may be contained in a saturated or super-saturated state.

In order to enhance the life time of the electrolyte solution or improve other characteristics thereof, the film-forming stabilizer (surface-hardening additive) can be added to the electrolyte solution. That is, in accordance with the present invention, the electrolyte solution can be prepared by adding the film-forming stabilizer to the aqueous alkali solution.

As the film-forming stabilizers, inorganic compounds or organic compounds can be used. Specific examples of the inorganic compounds suitably used as the film-forming stabilizer may include salts of mineral acids such as sodium nitrate ($NaNO_3$), potassium nitrate ($KNO_3$), calcium nitrate ($Ca(NO_3)_2$), magnesium nitrate ($Mg(NO_3)_2$), sodium sulfate ($Na_2SO_4$), potassium sulfate ($K_2SO_4$), calcium sulfate ($CaSO_4$), magnesium sulfate ($MgSO_4$) or ammonium sulfate ($(NH_4)_2SO_4$), fluorides such as potassium fluoride (KF), magnesium fluoride ($MgF_2$) or ammonium fluoride ($NH_4F$), silicates such as sodium meta-silicate ($Na_2SiO_3$), sodium ortho-silicate ($Na_4SiO_4$) or potassium bi-silicate ($K_2SiO_2$), silicofluorides such as sodium silicofluoride ($Na_2SiF_6$), magnesium silicofluoride ($MaSiF_6$) or ammonium silicofluoride ($(NH_4)_2SiF_6$), or the like. Specific examples of the organic compounds suitably used as the film-forming stabilizer may include alcohols such as $(CH_2OH)_2$, $(CH_2CH_2OH)O$ or $(CH_2OH)_2CHOH$, carboxylic acids or derivatives therefrom such as $(COOH)_2$, $(CH_2CH_2COOH)_2$, $[CH(OH)COOH]_2$, $C_6H_4(OH)COOH$, $C_6H_5COOH$ or $C_6H_4(COOH)_2$, sulfone-containing compounds such as $C_6H_4(SO_3H)COOH$ or $C_6H_3(OH)(COOH)SO_3H$, or the like.

Organometal compounds derived from these organic compounds can be also used.

These film-forming stabilizers (surface-hardening additives) can be used singly or in the form of a mixture of any two or more thereof. Especially, when the aforementioned inorganic and organic compounds are used in combination, it is possible to produce a good anodic oxide film, and further the electrolyte solution can be readily handled or controlled.

The content of the film-forming stabilizer in the electrolyte solution is in the range of 0.01 to 5 mol per liter, preferably 0.05 to 2 mol per liter. When the content of the film-forming stabilizer is less than 0.01 mol per liter, the electrolytic bath becomes unstable. On the other hand, when the content of the film-forming stabilizer is more than 5 mol per liter, there occur so-called "blushing", "unevenness" or "smut," whereby care must be taken upon use.

In accordance with the present invention, the electrolysis (anodic oxidization) is carried out by immersing the magnesium-based metal material in the thus-adjusted electrolytic solution. At this time, the electrolytic bath may be maintained at a temperature of 30° to 90° C., preferably 50° to 80° C. When the temperature of the electrolytic bath is less than 30° C., the resultant anodic oxide film has an undesired large surface roughness. On the other hand, when the temperature of the electrolytic bath is more than 90° C., there arises such a problem that mist or vapor of the electrolyte solution is generated upon the electrolytic reaction so that the electrolytic bath is rendered unstable.

In addition, the time of electrolysis is varied depending upon kinds of the magnesium-based metal materials used, the composition of the electrolyte solution, kinds of additives and the treating temperature and therefore cannot be specifically determined. However, from the standpoints of surface roughness, luster, color tone or the like of the anodic oxide film formed, the electrolysis is generally conducted for about 3 to about 60 minutes.

As an electric power source for the electrolysis, D.C power source, A.C. power source, PR power source, pulse power source or the like can be optionally used. The preferred electric power source is D.C. power source or A.C. power source in view of its low cost and high stability.

As described above, in accordance with the present invention, the anodic oxide film can be produced without any process using toxic substances such as heavy metals.

In consequence, the anodic oxide film prepared according to such a process contains no toxic substances, so that any problem of environmental pollution does not arise upon recycling thereof.

In addition, the anodic oxide film prepared according to the present invention has a color tone from white to gray and from gray to bronze and is excellent in surface smoothness, corrosion resistance, hardness, adhesion upon coating and color tone.

EXAMPLES

The present invention is described in more detail below by way of examples.

Example 1

In this example, various experiments were conducted while varying the electrolytic conditions such as a current density, an elapsed time of electrolysis, a temperature of an electrolytic bath and the like.

First, a rolled plate made of magnesium (tradename: AZ31, size: 70 mm×150 mm×31 mm) was degreased and pickled with an acid. Thereafter, the magnesium rolled plate was immersed in an electrolytic bath maintained at 60° C. and subjected to an A.C. electrolysis. The A.C. electrolysis was conducted at a current density of 1 to 10 A/dm$^2$ for 20 minutes. The thus-treated magnesium rolled plate was washed with water and then dried.

The electrolytic bath used above was composed of 2.67 mol/liter of KOH, 0.11 mol/liter of $C_3H_8O_3$, 0.02 mol/liter of $C_4H_4O_6K_2$ and 0.09 mol/liter of KF.

The thus-formed anodic oxide film was evaluated with respect to its color tone, film thickness, surface roughness corrosion resistance and hardness.

(1) Current Density, Elapsed Time of Electrolysis, Color Tone and Film Thickness:

The relationship between the current density, the color tone and the film thickness were shown in Table 1 below.

TABLE 1

| Current density (A/dm$^2$) | 1 | 2 | 4 | 6 | 8 | 10 |
|---|---|---|---|---|---|---|
| Color tone | color of material itself | trans-lucent | light gray | light gray brown | gray brown | gray |
| Film thickness (μm) | 2 | 6 | 8 | 10 | 12 | 14 |

It was recognized from Table 1 that the color tone of the resultant anodic oxide film was changed from the color of the material itself to light gray and further from light gray to gray as the current density applied was increased. Further, in association with the increase in current density, the thickness of the anodic oxide film was also increased.

Figure 2:
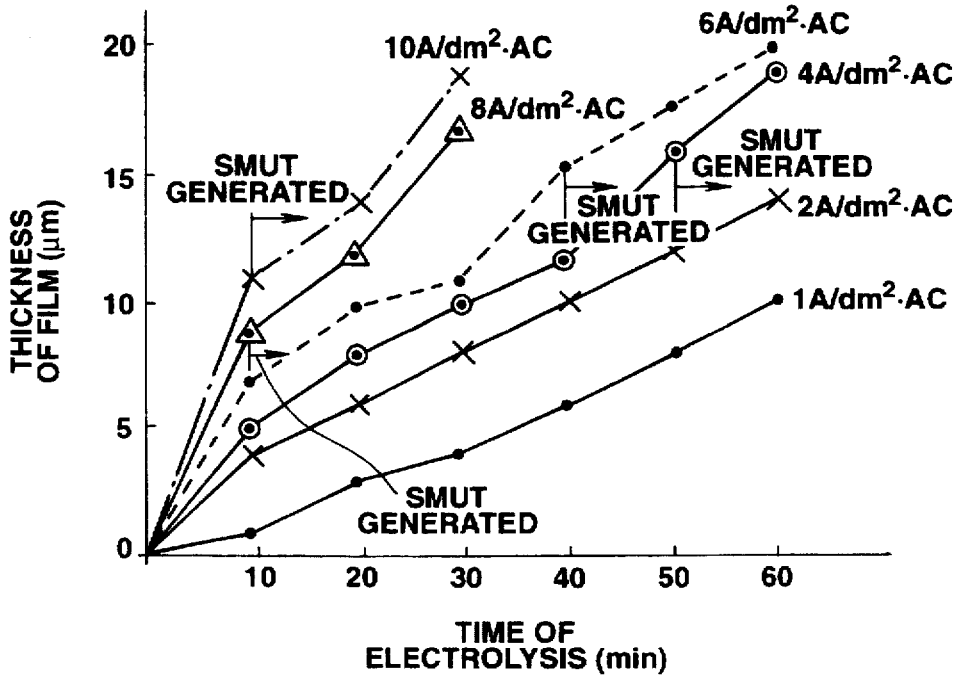
FIG. 2 is a characteristic curve showing a change in thickness of an anodic oxide film with respect to current densities and elapsed time of electrolysis.

In addition, FIG. 1 shows the change in color tone of the resultant anodic oxide film with respect to the elapsed time of the electrolysis at each current density and FIG. 2 shows the change in thickness of the resultant anodic oxide film with respect to the elapsed time of the electrolysis at each current density.

Figure 3:
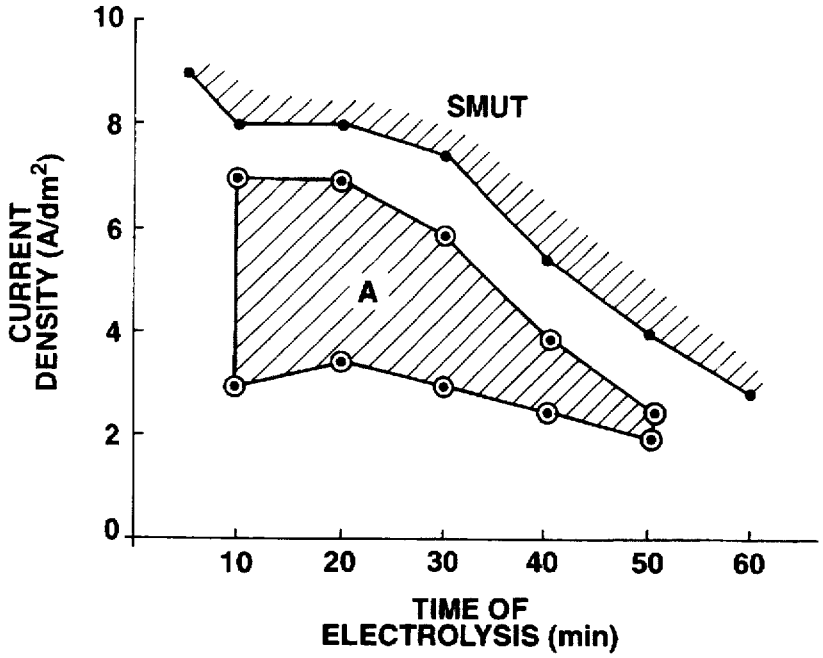
FIG. 3 is a characteristic curve showing an optimum range of current densities and elapsed time of electrolysis.

From these figures, it was revealed that the color tone of the resultant anodic oxide film was changed from light gray to gray via light gray brown and gray brown as the time of the electrolysis was prolonged at each current density. Further, the thickness of the resultant anodic oxide film was also gradually increased as the time of the electrolysis was prolonged at each current density. However, when too high current density is applied or too prolonged time of the electrolysis was used, smut was generated. Hence, in order to obtain the anodic oxide film having a color tone of light gray brown to gray brown while preventing the generation of smut, the current density and the elapsed time of the electrolysis were adjusted to values in the hatched range A shown in FIG. 3.

(2) Surface Roughness and Hardness:

A surface of the magnesium rolled plate was polished so as to have a center line average surface roughness Ra of about 2 μm. The magnesium rolled plate was anodized in the same manner as described above. Incidentally, the electrolysis (anodic oxidation) was conducted at a current density of 4 A/dm$^2$ for 20 minutes.

The resultant anodic oxide film was evaluated with respect to its surface roughness and hardness. In the evaluation, the surface roughness of the resultant anodic oxide film was measured by a universal shape-measuring device and the hardness thereof was measured by a sclerometer and a microhardness tester. Furthermore, the conventional anodic oxide films widely utilized in various fields were tested for comparative purposes in Comparative Example 1 (thin film of HAE), Comparative Example 2 (thick film of HAE), Comparative Example 3 (thin film of Dow 17) and Comparative Example 4 (thick film of Dow). These Comparative Examples were conducted in the same manner as described above. The results are shown in Table 2 below.

TABLE 2

| | Surface roughness Ra (μm) | Hardness: Scratch hardness | Hardness: Vickers hardness (Hv) |
|---|---|---|---|
| Example 1 | 3–5 | 350 | 220–230 |
| Comparative Example 1 | 4–6 | 50 | not measurable |
| Comparative Example 2 | 18–25 | 800< | 520–550 |
| Comparative Example 3 | 4–6 | 50 | not measurable |
| Comparative Example 4 | 10–15 | 800< | 480–500 |

The anodic oxide film sample prepared in Example 1 according to the present invention exhibited not only an excellent surface smoothness but also a sufficient hardness. On the other hand, the conventional thin film samples of Comparative Examples 1 and 3 showed an excellent surface smoothness but were unsatisfactory in hardness. Further, the thick film samples of Comparative Examples 2 and 4 had a sufficient hardness but an undesired large surface roughness.

Figure 4:
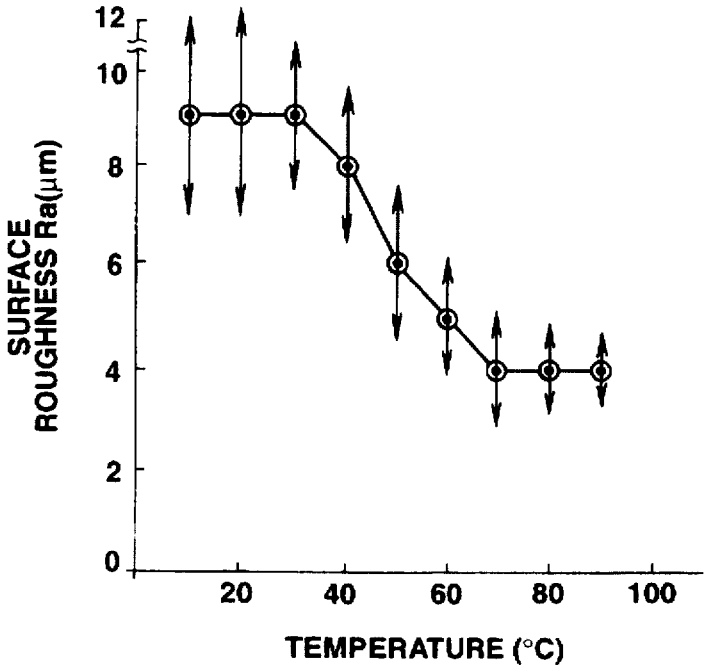
FIG. 4 is a characteristic curve showing a relationship between a temperature of an electrolytic bath and a surface roughness of an anodic oxide film.

FIG. 4 shows a change in surface roughness when the temperature of the electrolytic bath was varied while being kept the current density and the elapsed time of the electrolysis constant.

As will be appreciated from FIG. 4, when the temperature of the electrolytic bath reached 30° C. or more, the surface roughness of the anodic oxide film was suddenly decreased. Accordingly, in order to realize a good surface smoothness of the anodic oxide film, it is required to adjust the temperature of the electrolytic bath to an appropriate range.

(3) Corrosion Resistance:

The magnesium rolled plate was anodized or electrolyzed at a current density of 4 A/dm$^2$ for 20 minutes in the same manner as described above. The thus-treated rolled magnesium plate was subjected to a salt spray test according to JIS Z-2371 using a 5 weight % aqueous solution of sodium chloride, and evaluated by rating numbers (R.N.). Incidentally, the anodic oxide film samples used in Comparative Examples 1 to 4 were tested in the same manner and the test results were compared with those of the aforementioned anodic oxide film of Example 1 according to the present invention. The results are shown in Table 3 below.

TABLE 3

| | untreated material | Ex. 1 | Comp. Ex. 1 | Comp. Ex. 2 | Comp. Ex. 3 | Comp. Ex. 4 |
|---|---|---|---|---|---|---|
| 8 hrs. | 9.5 | 10 | 10 | 10 | 10 | 10 |
| 24 hrs. | 8.0 | 10 | 10 | 10 | 10 | 10 |
| 48 hrs. | Removed | 10 | 9.8 | 10 | 9.8 | 10 |
| 72 hrs. | — | 10 | 9.8 | 10 | 9.6 | 10 |
| 96 hrs. | — | 10 | 9.5 | 10 | 9.3 | 10 |

TABLE 3-continued

| | untreated material | Ex. 1 | Comp. Ex. 1 | Comp. Ex. 2 | Comp. Ex. 3 | Comp. Ex. 4 |
|---|---|---|---|---|---|---|
| 120 hrs. | — | 10 | 9.0 | 10 | 9.0 | 10 |
| 240 hrs. | — | 9.5 | 8.0 | 10 | 8.0 | 10 |

As is apparent from Table 3, the anodic oxide film samples prepared in Example 1 according to the present invention exhibited a good corrosion resistance identical to those of the thick film samples of Comparative Examples 2 and 4.

Example 2

The anodic oxidation treatment was repeated in the same manner as described in Example 1 except that the electrolytic bath contained NaOH instead of KOH. Specifically, the electrolysis (anodic oxidation) was conducted at a current density of 4 A/dm$^2$ for 20 minutes while maintaining the electrolytic bath at 60° C.

The thus-prepared anodic oxide film was evaluated in the same manner as in Example 1. The anodic oxide film showed a surface roughness and a hardness similar to those of Example 1. On the other hand, there was observed a tendency that the color tone of Example 2 became somewhat thinner than that of Example 1. In addition, when D.C. power source was used, the anodic oxide film prepared showed somewhat red brown color.

Example 3

Using an electrolytic bath containing 3.75 mol/liter of NaOH, 0.22 mol/liter of $K_2CO_3$, 0.16 mol/liter of $C_2O_4K_2$ and 0.07 mol/liter of NaF, a magnesium rolled plate was subjected to an A.C. electrolysis. The A.C. electrolysis was conducted at a current density of 4 A/dm$^2$ for 20 minutes while maintaining the temperature of the electrolytic bath at 60° C. to prepare an anodic oxide film thereon. After drying, the thus-prepared anodic oxide film was evaluated with respect to items identical to those of Example 1. The results are shown in Table 4.

TABLE 4

| Color tone | Surface roughness Ra (μm) | Film thickness (μm) | Scratch hardness (gf) | Vickers hardness (Hv) | Corrosion resistance |
|---|---|---|---|---|---|
| Light gray brown | 4–6 | 10–12 | 350–400 | 220–250 | 120 hrs. RN 9.8 |

As is appreciated from Table 4, the anodic oxide film of Example 3 showed a slightly deteriorated surface roughness as compared to those of the anodic oxide films obtained in Examples 1 and 2, but the surface roughness of the anodic oxide film of Example 3 was superior to those of the thin film samples of Comparative Examples 1 and 3. Further, when a D.C. power source was used instead of the A.C. power source, the anodic oxide film prepared showed a red brown color.

Example 4

Using an electrolytic bath containing 5 mol/liter of KOH, 1.6 mol/liter of $(CH_2OH)_2$, 0.03 mol/liter of $C_6H_4(OH)$ COONa and 0.12 mol/liter of NaF, a magnesium rolled plate was subjected to an A.C. electrolysis. The A.C. electrolysis was conducted at a current density of 4 A/dm$^2$ for 20 minutes while maintaining the temperature of the electrolytic bath at 60° C., to prepare an anodic oxide film thereon. After drying, the thus-prepared anodic oxide film was evaluated with respect to items identical to those of Example 1. The results are shown in Table 5.

TABLE 5

| Color tone | Surface roughness Ra (μm) | Film thickness (μm) | Scratch hardness (gf) | Vickers hardness (Hv) | Corrosion resistance |
|---|---|---|---|---|---|
| Gray brown | 4–6 | 8–10 | 350–400 | 240–270 | 120 hrs. RN 9.8 |

As is appreciated from Table 5, the anodic oxide film of Example 4 showed a slightly thick color tone as compared to that of the anodic oxide film obtained in Example 1, but the other properties of the anodic oxide film of Example 4 was identical or superior thereto. Further, when a D.C. power source was used instead of the A.C. power source, the anodic oxide film prepared showed a red brown color.

Example 5

Using an electrolytic bath containing 4 mol/liter of KOH, 0.94 mol/liter of $(CH_2CH_2OH)_2O$, 0.08 mol/liter of $Na_2SiO_3$ and 0.16 mol/liter of KF, a magnesium rolled plate was subjected to an A.C. electrolysis. The A.C. electrolysis was conducted at a current density of 4 A/dm$^2$ for 20 minutes while maintaining the temperature of the electrolytic bath at 70° C., to prepare an anodic oxide film thereon. After drying, the thus-prepared anodic oxide film was evaluated with respect to items identical to those of Example 1. The results are shown in Table 6.

TABLE 6

| Color tone | Surface roughness Ra (μm) | Film thickness (μm) | Scratch hardness (gf) | Vickers hardness (Hv) | Corrosion resistance |
|---|---|---|---|---|---|
| Gray brown | 4–8 | 8–10 | 350–400 | 220–250 | 120 hrs. RN 9.8 |

As is appreciated from Table 6, the anodic oxide film of Example 5 showed a slightly thick color tone as compared to that of the anodic oxide film obtained in Example 1, but the other properties of the anodic oxide film of Example 5 was identical to those of Example 1. Further, when a D.C. power source was used instead of the A.C. power source, the anodic oxide film prepared showed a red brown color.

Example 6

Using an electrolytic bath containing 4 mol/liter of KOH, 1.08 mol/liter of $(CH_2OH)_2CHOH$ and 0.05 mol/liter of $Na_2SiF_6$, a magnesium rolled plate was subjected to an A.C. electrolysis. The A.C. electrolysis was conducted at a current density of 4 A/dm$^2$ for 20 minutes while maintaining the temperature of the electrolytic bath at 70° C., to prepare an anodic oxide film thereon. After drying, the thus-prepared anodic oxide film was evaluated with respect to items identical to those of Example 1. The results are shown in Table 7.

TABLE 7

| Color tone | Surface roughness Ra (μm) | Film thickness (μm) | Scratch hardness (gf) | Vickers hardness (Hv) | Corrosion resistance |
|---|---|---|---|---|---|
| Light gray brown | 4–6 | 7–9 | 300–350 | 220–240 | 120 hrs. RN 9.5 |

As is appreciated from Table 7, the anodic oxide film of Example 6 showed a slightly thick color tone as compared to that of the anodic oxide film obtained in Example 1, but the other properties of the anodic oxide film of Example 6 were identical to those of Example 1. Further, when a D.C. power source was used instead of the A.C. power source, the anodic oxide film prepared somewhat showed a red brown color.

As is apparently understood from the above description, in accordance with the method for surface-treating a substrate composed of a magnesium-based metal material, it becomes possible to form an anodic oxide film having excellent color tone, surface smoothness, corrosion resistance, abrasion resistance and coating adhesion, on a surface of the substrate.

Further, in accordance with the present invention, since the effluent discharged from the anodic oxidation system does not contain any heavy metals, there is little risk of causing environmental pollution. In addition, a re-melting process required to recycle the surface-treated product can be carried out without necessity of special pre-treatments, whereby the risk of causing environmental pollution is further lessened.

Furthermore, in accordance with the present invention, differing from the conventional method in which a finishing coat is directly provided on a surface of the magnesium-based metal material, the coating operation thereof can be selectively made in two different manners, i.e., one includes only an anodizing treatment while the other include an anodizing treatment followed by finish-coating. This renders the magnesium-based metal material widely applicable to casings or receptacles, for example, those for computers, audio equipments, communication equipments or the like.

What is claimed is:

1. A method for surface-treating a substrate made of magnesium or a magnesium alloy, comprising the steps of:

immersing a substrate of magnesium or magnesium alloy in an electrolytic solution comprising an aqueous solution of at least one first component selected from the group consisting of alkali metal hydroxides, alkali metal carbonates, alkali metal bicarbonates, alkaline earth metal hydroxides, alkaline earth metal carbonates and alkaline earth metal bicarbonates; and at least one second component selected from the group consisting of salts of mineral acids, fluorides, silicates and silicofluorides; and at least one third component selected from the group consisting of ethylene glycol, trihydroxypropane, dihydroxyethyl ether and sodium hydroxybenzoate; and conducting electrolysis to form an anodic oxide film on a surface of said substrate.

2. A method as claimed in claim 1, wherein the concentration of said first component is from about 0.2 to about 10 moles/liter.

3. A method as claimed in claim 1, wherein the concentration of the second and the third components together is from about 0.01 to about 5 moles/liter.

4. A method as claimed in claim 1, wherein said electrolysis is conducted at a temperature of from about 30° C. to about 90° C.

5. A surface treated magnesium or a magnesium alloy substrate which is surface-treated by the method according to claim 1.

* * * * *